US010543531B2

(12) United States Patent
Saiwai et al.

(10) Patent No.: US 10,543,531 B2
(45) **Date of Patent: *Jan. 28, 2020**

(54) POROUS ALUMINUM SINTERED MATERIAL AND METHOD OF PRODUCING POROUS ALUMINUM SINTERED MATERIAL

(71) Applicant: MITSUBISHI MATERIALS CORPORATION, Tokyo (JP)

(72) Inventors: Toshihiko Saiwai, Kitamoto (JP); Ji-bin Yang, Kitamoto (JP); Koichi Kita, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 251 days.

This patent is subject to a terminal disclaimer.

(21) Appl. No.: 15/522,310

(22) PCT Filed: Oct. 28, 2015

(86) PCT No.: PCT/JP2015/080358

§ 371 (c)(1),
(2) Date: Apr. 27, 2017

(87) PCT Pub. No.: WO2016/068176

PCT Pub. Date: May 6, 2016

(65) Prior Publication Data

US 2018/0290211 A1 Oct. 11, 2018

(30) Foreign Application Priority Data

Oct. 30, 2014 (JP) ..... 2014-221244

(51) Int. Cl.
*B22F 7/00* (2006.01)
*B22F 3/11* (2006.01)
(Continued)

(52) U.S. Cl.
CPC ..... *B22F 3/1103* (2013.01); *B22F 1/00* (2013.01); *B22F 3/11* (2013.01); *C22C 1/04* (2013.01);
(Continued)

(58) Field of Classification Search
None
See application file for complete search history.

(56) References Cited

U.S. PATENT DOCUMENTS 3,301,671 A 1/1967 Storchheim
5,098,469 A 3/1992 Rezhets
(Continued)

FOREIGN PATENT DOCUMENTS

CA 1176490 A 10/1984
CN 1373233 A 10/2002
(Continued)

OTHER PUBLICATIONS

International Search Report dated Dec. 8, 2015, issued for PCT/JP2015/080358 and English translation thereof.
(Continued)

*Primary Examiner* — Seth Dumbris
(74) *Attorney, Agent, or Firm* — Locke Lord LLP

(57) ABSTRACT

A porous aluminum sintered material is provided. The porous aluminum sintered material includes aluminum substrates sintered each other, wherein pillar-shaped protrusions projecting toward an outside are formed on outer surfaces of the aluminum substrates, the porous aluminum sintered material has junctions in which the aluminum substrates are bonded each other through the pillar-shaped protrusions, the junctions include a Ti—Al compound, and a eutectic alloy phase including Al and Si is provided on surface layers of the junctions.

3 Claims, 12 Drawing Sheets

(51) Int. Cl.

| | |
|---|---|
| ***B22F 1/00*** | (2006.01) |
| ***C22C 1/04*** | (2006.01) |
| ***C22C 21/00*** | (2006.01) |
| ***C22C 21/02*** | (2006.01) |

(52) U.S. Cl.
CPC ..... *C22C 21/00* (2013.01); *C22C 21/02* (2013.01); *B22F 2301/052* (2013.01); *B22F 2304/10* (2013.01); *Y10T 428/12056* (2015.01)

(56) References Cited

U.S. PATENT DOCUMENTS

| | | | | |
|---|---|---|---|---|
| 5,788,737 | A * | 8/1998 | Wakiyama | C22C 1/0416 75/249 |
| 6,391,250 | B1 | 5/2002 | Wolfsgruber et al. | |
| 2003/0232124 | A1 | 12/2003 | Medlin et al. | |
| 2009/0202812 | A1 | 8/2009 | Schaeffler et al. | |
| 2012/0094142 | A1 | 4/2012 | Hoshino et al. | |
| 2012/0135142 | A1 | 5/2012 | Yang et al. | |
| 2013/0305673 | A1 | 11/2013 | Zeller | |

FOREIGN PATENT DOCUMENTS

| | | | |
|---|---|---|---|
| CN | 102365143 | A | 2/2012 |
| CN | 102438778 | A | 5/2012 |
| CN | 102458725 | A | 5/2012 |
| CN | 102717181 | A | 10/2012 |
| DE | 4426627 | A1 | 2/1995 |
| EP | 1402978 | A1 | 3/2004 |
| EP | 2939762 | A1 | 11/2015 |
| EP | 3144082 | A1 | 3/2017 |
| EP | 3150305 | A1 | 4/2017 |
| EP | 3165864 | A1 | 5/2017 |
| EP | 3213839 | A1 | 9/2017 |
| JP | 56-077301 | A | 6/1981 |
| JP | 56-149363 | A | 11/1981 |
| JP | 61-048566 | B2 | 10/1986 |
| JP | 62-050742 | B2 | 10/1987 |
| JP | 63-140783 | A | 6/1988 |
| JP | H03-110045 | A | 5/1991 |
| JP | 04-037658 | A | 2/1992 |
| JP | 08-145592 | A | 6/1996 |
| JP | 08-325661 | A | 12/1996 |
| JP | 08-325662 | A | 12/1996 |
| JP | 2006-028616 | A | 2/2006 |
| JP | 2008-020864 | A | 1/2008 |
| JP | 4303649 | B2 | 7/2009 |
| JP | 2009-256788 | A | 11/2009 |
| JP | 2010-500469 | A | 1/2010 |
| JP | 2010-116623 | A | 5/2010 |
| JP | 2010-255089 | A | 11/2010 |
| JP | 2010-280951 | A | 12/2010 |
| JP | 2010-283042 | A | 12/2010 |
| JP | 2011-023430 | A | 2/2011 |
| JP | 2011-049023 | A | 3/2011 |
| JP | 2011-077269 | A | 4/2011 |
| JP | 2011-214049 | A | 10/2011 |
| JP | 2011-253645 | A | 12/2011 |
| JP | 2012-119465 | A | 6/2012 |
| JP | 2014-025148 | A | 2/2014 |
| JP | 2014-031585 | A | 2/2014 |
| JP | 2014-141733 | A | 8/2014 |
| JP | 2014-194074 | A | 10/2014 |
| JP | 2014-194075 | A | 10/2014 |
| JP | 2015-151609 | A | 8/2015 |
| WO | 2008/017111 | A1 | 2/2008 |
| WO | 2010/116679 | A1 | 10/2010 |
| WO | 2014/133077 | A1 | 9/2014 |
| WO | 2014/133079 | A1 | 9/2014 |

OTHER PUBLICATIONS

Office Action dated Jul. 18, 2018, issued for the Chinese patent application No. 201580058206.2 and a partial translation of the search report.
Search Report dated Mar. 22, 2018, issued for the European patent application No. 15855571.4.
International Search Report dated Jun. 30, 2015, issued for PCT/JP2015/064180 and English tarnslation thereof.
Office Action dated Apr. 6, 2017, issued for the Chinese patent application No. 201580015338.7 and English translation thereof.
Search Report dated Dec. 15, 2017, issued for the European patent application No. 157919853.
Office Action dated Mar. 2, 2018, issued for the Chinese patent application No. 201580015338.7 and English translation thereof.
Office Action dated Sep. 3, 2018, issued for the Chinese patent application No. 201580015338.7 and a partial English translation of the search report.
Office Action dated Dec. 11, 2018, issued for the Japanese patent application No. 2015-099293 and English translation thereof.
International Search Report dated Sep. 1, 2015, issued for PCT/JP2015/065778 and English trnalation thereof.
Office Action dated May 11, 2017, issued for the Chinese patent application No. 201580012200.1 and English translation thereof.
Search Report dated Dec. 21, 2017, issued for the European patent application No. 157993593.
Bo Wang et al., "Effects of Pulse Current on Transient Liquid Phase (TLP) Diffusion Bonding of SiCp/2024Al Composites Sheet Using Mixed Al, Cu, and Ti Powder Interlayer", Metallurgical and Materialstransactions A, Springer-Verlag, New York, vol. 43, No. 9, Jul. 10, 2012, pp. 3039-3042.
Search Report dated Jun. 26, 2018, issued for the European patent applictaion No. 15799359.3.
Merriam-Webster, "Definition of include", accessed Jan. 23, 2018, <https://www.merriam-webster.com/dictionary/include>-webster.com/dictionary/include.
Office Action dated May 22, 2018, issued for U.S. Appl. No. 15/302,374.
Office Action dated Sep. 26, 2018, issued for U.S. Appl. No. 15/302,374.
Office Action dated Apr. 2, 2019, issued for U.S. Appl. No. 15/302,374.
Office Action dated Mar. 29, 2019, issued for U.S. Appl. No. 15/306,252.

* cited by examiner

POROUS ALUMINUM SINTERED MATERIAL AND METHOD OF PRODUCING POROUS ALUMINUM SINTERED MATERIAL

TECHNICAL FIELD

The present invention relates to a porous aluminum sintered material, in which aluminum substrates are sintered each other, and a method of producing a porous aluminum sintered material.

Priority is claimed on Japanese Patent Application No. 2014-221244, filed Oct. 30, 2014, the content of which is incorporated herein by reference.

BACKGROUND ART

The above-described porous aluminum sintered material is used as electrodes and current collectors in various batteries; parts of heat exchangers; sound deadening parts; filters; shock-absorbing parts; and the like, for example.

Conventionally, these porous aluminum sintered materials are produced by methods disclosed in Patent Literatures 1 to 5 (PTLs 1 to 5), for example.

In PTL 1, a porous aluminum sintered material is produced as explained below. First, a mixture formed by mixing aluminum powder; paraffin wax grains; and a binder, is shaped into a sheet-shaped form and then, subjected to natural drying. Then, the wax grains are removed by dipping the dried sheet in an organic solvent. Then, the sheet is subjected to drying, defatting, and sintering to obtain the porous aluminum sintered material.

In PTLs 2-4, porous aluminum sintered materials are produced by forming viscous compositions by mixing aluminum powders, sintering additives including titanium, binders, plasticizers, and organic solvents; foaming after shaping the viscous compositions; and then heat-sintering under a non-oxidizing atmosphere.

In PTL 5, a porous aluminum sintered material is produced by mixing a base powder made of aluminum, an Al alloy powder including a eutectic element for forming bridging, and the like; and heat-sintering the obtained mixture under a hydrogen atmosphere or in a mixed atmosphere of hydrogen and nitrogen. The porous aluminum sintered material has a structure in which grains of the base powder made of aluminum are connected each other by bridge parts made of a hypereutectic organization.

CITATION LIST

Patent Literature

PTL 1: Japanese Unexamined Patent Application, First Publication No. 2009-256788 (A)

PTL 2: Japanese Unexamined Patent Application, First Publication No. 2010-280951 (A)

PTL 3: Japanese Unexamined Patent Application, First Publication No. 2011-023430 (A)

PTL 4: Japanese Unexamined Patent Application, First Publication No. 2011-077269 (A)

PTL 5: Japanese Unexamined Patent Application, First Publication No. H08-325661 (A)

SUMMARY OF INVENTION

Technical Problem

In the porous aluminum sintered material and the method of producing the porous aluminum sintered material described in PTL 1, there is a problem that obtaining one with a high porosity is hard. In addition, there are problems that bonding of aluminum substrates each other is inhibited by strong oxide films formed on the surfaces of the aluminum substrates in the case where the aluminum substrates are sintered each other; and a porous aluminum sintered material with sufficient strength cannot be obtained.

In the porous aluminum sintered materials and the methods of producing the porous aluminum sintered material described in PTLs 2-4, there is a problem that the porous aluminum sintered materials cannot be produced efficiently since the viscous compositions are subjected to shaping and foaming. In addition, there are problems that it takes a long time for the binder removal process since the viscous compositions contain large amounts of binders; the shrinkage ratios of the compacts increase during sintering; and a porous aluminum sintered material having excellent dimensional accuracy cannot be obtained.

In addition, in the porous aluminum sintered material and the method of producing the porous aluminum sintered material described in PTL 5, the porous aluminum sintered material has the structure in which grains of the base powder made of aluminum are connected each other by bridge parts made of a hypereutectic organization. In this bridge part, the low-melting temperature Al alloy powder having a eutectic composition is melted and a liquid phase is formed; and the bridge part is formed by this liquid phase being solidified between grains of the base powder. Therefore, it is hard to obtain a porous aluminum sintered material with high porosity in the porous aluminum sintered material and the method of producing a porous aluminum sintered material described in PTL 5.

In addition, the electric resistance and the thermal resistance are increased in the porous aluminum sintered material described in PTL 5, since the entire bridge part becomes the hyper eutectic structure. Thus, there is a problem that the electrical resistance and the thermal resistance of the porous aluminum sintered material are reduced.

The present invention is made under the circumstances explained above. The purpose of the present invention is to provide a porous aluminum sintered material having a high porosity; a sufficient strength; and excellent electrical conductivity and thermal conductivity. In addition, a method of producing the porous aluminum sintered material is provided.

Solution to Problem

In order to achieve the purpose by solving the above-mentioned technical problems, the present invention has an aspect, which is a porous aluminum sintered material including a plurality of aluminum substrates sintered each other, wherein pillar-shaped protrusions projecting toward an outside are formed on outer surfaces of the aluminum substrates, the porous aluminum sintered material has junctions in which the aluminum substrates are bonded each other through the pillar-shaped protrusions, the junctions include Ti—Al compound, and a eutectic alloy phase including Al and Si is provided on surface layers of the junctions.

According to the porous aluminum sintered material configured as described above, which is an aspect of the present invention, diffusion migration of aluminum is suppressed since the junction of the aluminum substrates includes the Ti—Al compound. Therefore, voids can be maintained between the aluminum substrate; and a porous aluminum sintered material having high porosity can be obtained.

In addition, the porous aluminum sintered material has a structure in which the aluminum substrates are bonded each other through the pillar-shaped protrusions formed on the outer surfaces of the aluminum substrates. Thus, a porous aluminum sintered material having high porosity can be obtained without performing the step of foaming or the like separately. Therefore, the porous aluminum sintered material can be produced efficiently at low cost.

In addition, the porous aluminum sintered material, which has an excellent dimensional accuracy with a low shrinkage ratio during sintering and sufficient strength, can be obtained, since there is a less amount of binders between the aluminum substrates unlike the viscous compositions.

In addition, since the eutectic alloy phase including Al and Si is provided in the junctions where each of aluminum substrates is bonded each other, these junctions are strengthened by the eutectic alloy phase. Thus, the strength of the entire porous aluminum sintered material can be improved.

Furthermore, since the eutectic alloy phase including Al and Si is provided on the surface layer of the junctions, the inside part of the junction has a lower Si concentration than the outer layer part. Thus, the electrical resistance and the thermal resistance in the junctions are kept low; and the electrical conductivity and the thermal conductivity of the porous aluminum sintered material can be kept high.

In the porous aluminum sintered material of the present invention, the eutectic alloy phase may further include Mg.

In this case, the eutectic point becomes lower compared to the eutectic alloy phase free of Mg. Thus, the junctions can be further strengthened by this eutectic alloy phase; and the strength of the entire porous aluminum sintered material can be further improved. In addition to the Si concentration, even the concentration of Mg is lower in the inside part than the outer layer part of the junction. Thus, the electrical resistance and the thermal resistance of the junction are kept low; and the electrical conductivity and the thermal conductivity of the porous aluminum sintered material can be kept high.

In the porous aluminum sintered material of the present invention, the aluminum substrates may be made of any one of or both of aluminum fibers and aluminum powder. In addition, as the composition of the aluminum substrate, in addition to the pure aluminum, other general aluminum alloy can be suitably used.

In the case where the aluminum fibers are used as the aluminum substrates, the voids are likely to be held during bonding of the aluminum fibers through the pillar-shaped protrusions; and porosity tends to be increased. Accordingly, the porosity of the porous aluminum sintered material can be controlled by: using the aluminum fibers and the aluminum powder as the aluminum substrates; and adjusting their mixing ratios. Furthermore, even if the length of the fibers is identical, the porosity and the shape of the pore formed differ between fibers in a straight form and ones with deformation such as bending and twisting. Thus, by changing each parameter related to the form of the fibers including their lengths, the porosity and the structure of the pores can be controlled in the porous aluminum sintered material.

Another aspect of the present invention is a method of producing a porous aluminum sintered material including a plurality of aluminum substrates sintered each other, the method including the steps of: forming an aluminum raw material for sintering by adhering Ti—Si particles containing Ti and Si on outer surfaces of the aluminum substrates; laminating the aluminum raw material for sintering; and sintering the laminated aluminum raw material for sintering by heating, wherein a plurality of pillar-shaped protrusions projecting toward an outside is formed on locations where the Ti—Si particles are adhered among the aluminum substrates, and the plurality of aluminum substrates are bonded each other through the pillar-shaped protrusions.

In the method of producing a porous aluminum sintered material configured as described above, the porous aluminum sintered material is produced by sintering the aluminum raw material for sintering on which the Ti—Si particle containing Ti and Si is adhered on the outer surface of the aluminum substrate.

In the case where the above-described aluminum raw material for sintering is heated to near the melting point of the aluminum substrates in the step of sintering, the aluminum substrates are melted. However, oxide films are formed on the surfaces of the aluminum substrates; and the melted aluminum is held by the oxide films. As a result, the shapes of the aluminum substrates are maintained.

In the part where the Ti—Si particles are adhered among the outer surfaces of the aluminum substrates, the melting point decreases locally by the eutectic reaction of Si and Al; the oxide films are destroyed by the reaction with Ti; the melted aluminum inside spouts out; and the spouted out melted aluminum forms a high-melting point compound by reacting with titanium to be solidified. Because of this, the pillar-shaped protrusions projecting toward the outside are formed on the outer surfaces of the aluminum substrates. At this time, since the peritectic reaction of Al and Ti is an endothermic reaction, the spouted out melted aluminum solidifies in a short time. Thus, diffusion of Si into the inside of the pillar-shaped protrusions is suppressed; and the eutectic alloy phase including Al and Si on the surface layer of the pillar-shaped protrusions is formed.

As explained above, the diffusion migration of aluminum is suppressed, since multiple aluminum substrates are bonded each other through the junctions provided with the Ti—Al compound, thereby the voids are kept between each of the aluminum substrates; and the porous aluminum sintered material having a high porosity can be produced.

In addition, the junctions connected through the pillar-shaped protrusions can be strengthened, since the eutectic alloy phase including Si and Al is formed on the surface layer of the pillar-shaped protrusions. Thus, the porous aluminum sintered material having high strength can be produced.

In addition, the electrical resistance and the thermal resistance in the junctions connected through the pillar-shaped protrusions can be kept low, since the diffusion of Si into the inside of the pillar-shaped protrusions is suppressed. Thus the porous aluminum sintered material having excellent electrical conductivity and thermal conductivity can be produced In the method of producing a porous aluminum sintered material of the present invention, the Ti—Si particle may further include Mg.

In this case, the eutectic alloy phase provided to the surface layer of the pillar-shaped protrusion includes Mg, in addition to Al and Si. Thus, the pillar-shaped protrusions can be further strengthened; and the porous aluminum sintered material having higher strength can be produced. The electrical resistance and the thermal resistance in the junctions connected through the pillar-shaped protrusions can be kept low, since the diffusion of Mg into the inside part of the pillar-shaped protrusion is suppressed in addition to the diffusion of Si. Thus, the porous aluminum sintered material having excellent electrical conductivity and thermal conductivity can be produced.

In the method of producing a porous aluminum sintered material of the present invention, the aluminum raw material for sintering may have a composition including: besides the aluminum substrates, 0.1 mass % or more and 20 mass % or less of Ti; 0.1 mass % or more and 15 mass % or less of Si; and the balance of inevitable impurities.

In this case, the aluminum substrates are bonded each other reliably by forming the pillar-shaped protrusions, since it includes Ti at 0.1 mass % or more and Si at 0.1 mass % or more. In addition, the eutectic alloy phase is formed reliably; and the porous aluminum sintered material having a sufficient strength can be obtained. In addition, excessive formation of the liquid phase is suppressed, since the contents of Ti and Si are limited to 20 mass % or less and 15 mass % or less, respectively. Thus, the voids between each of the aluminum substrates being filled up with the melted aluminum can be prevented; and the porous aluminum sintered material having a high porosity can be obtained. In addition, increasing of the electrical resistance and the thermal resistance can be suppressed. Thus, the porous aluminum sintered material having excellent electrical conductivity and thermal conductivity can be produced.

In the method of producing a porous aluminum sintered material of the present invention, in addition to the aluminum substrates, the aluminum raw material for sintering may include: 0.1 mass % or more and 20 mass % or less of Ti; 0.1 mass % or more and 15 mass % or less of Si; 0.1 mass % or more and 5 mass % or less of Mg; and the balance of inevitable impurities.

In this case, the aluminum substrates are bonded each other reliably by forming the pillar-shaped protrusions, since it includes Ti at 0.1 mass % or more, Si at 0.1 mass % or more and 0.1 mass % or more of Mg. In addition, the eutectic alloy phase is formed reliably; and the porous aluminum sintered material having a sufficient strength can be obtained. In addition, excessive formation of the liquid phase is suppressed, since the contents of Ti, Si, and Mg are limited to 20 mass % or less, 15 mass % or less, and 5 mass % or less, respectively. Thus, the voids between each of the aluminum substrates being filled up with the melted aluminum can be prevented; and the porous aluminum sintered material having a high porosity can be obtained. In addition, increasing of the electrical resistance and the thermal resistance can be suppressed. Thus, the porous aluminum sintered material having excellent electrical conductivity and thermal conductivity can be produced.

In the method of producing a porous aluminum sintered material of the present invention, in addition to the aluminum substrates, the Ti—Si particle may be formed by mixing and pelletizing a powder material including: a Ti powder, which is made of one or both of metallic titanium and titanium hydride; and a Si powder, with a binder.

In this case, Ti and Si are adhered on the same location on the outer surface of the aluminum substrates reliably, since the Ti—Si particle formed by kneading and pelletizing the raw material powder including the Ti powder, which is made of any one or both of metallic titanium and titanium hydride, and the Si powder with the binder, is used.

Advantageous Effects of Invention

According to the present invention, a porous aluminum sintered material, which has a high porosity, a sufficient strength, and excellent electric conductivity and thermal conductivity; and a method of producing the porous aluminum sintered material are provided.

DESCRIPTION OF EMBODIMENTS

The porous aluminum sintered material 10, which is an embodiment of the present invention, is explained below in reference to the attached drawings.

Figure 1:
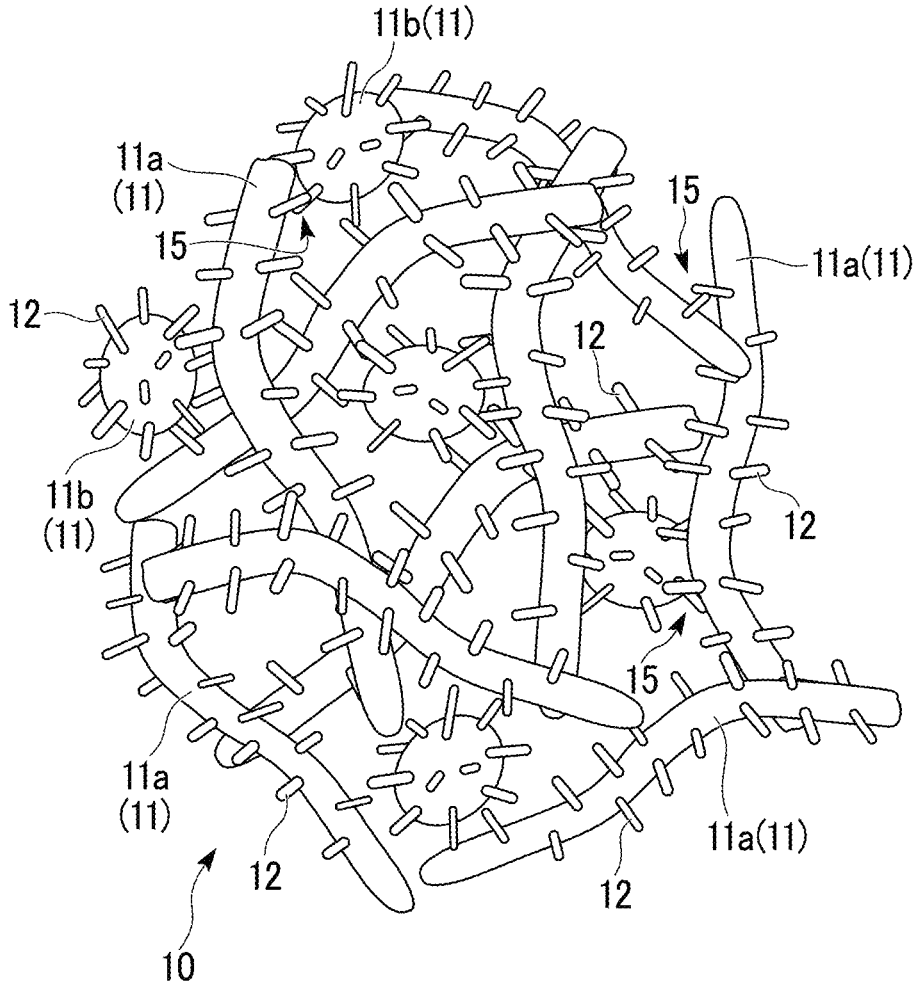
FIG. 1 is an enlarged schematic view of the porous aluminum sintered material of an embodiment related to the present invention.
Figure 2A:
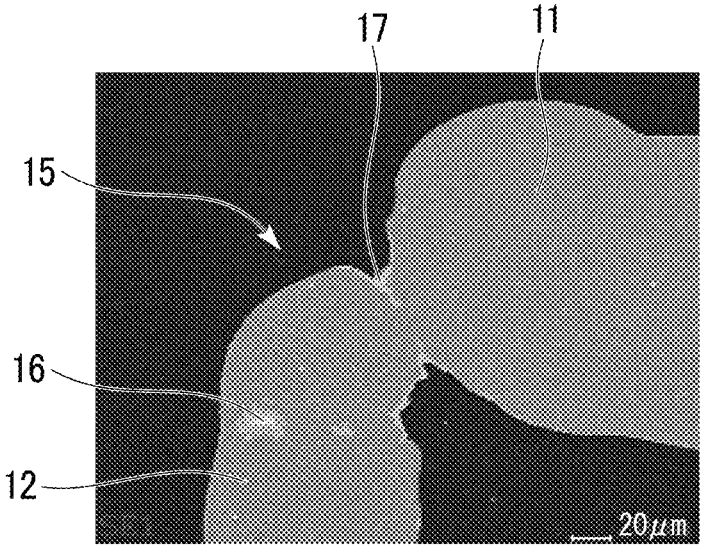
FIG. 2A is a diagram showing an SEM observation of the junction between the aluminum substrates of the porous aluminum sintered material shown in FIG. 1.
Figure 2B:
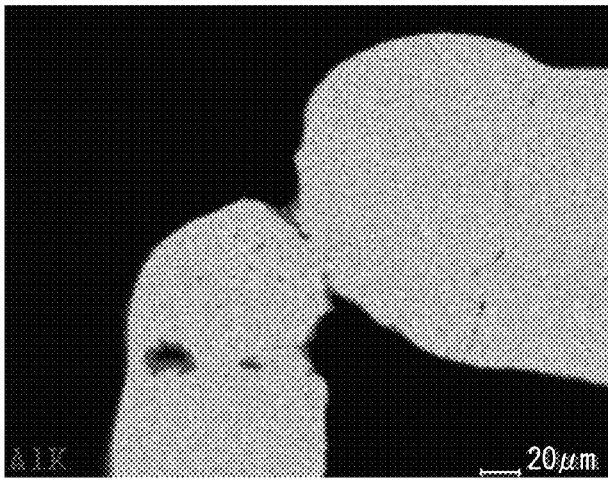
FIG. 2B is a diagram showing composition analysis results on aluminum in the junction between the aluminum substrates of the porous aluminum sintered material shown in FIG. 1.
Figure 2C:
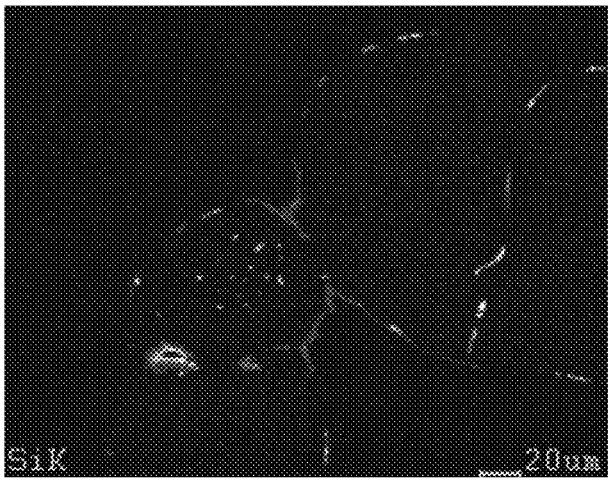
FIG. 2C is a diagram showing composition analysis results on silicon in the junction between the aluminum substrates of the porous aluminum sintered material shown in FIG. 1.
Figure 2D:
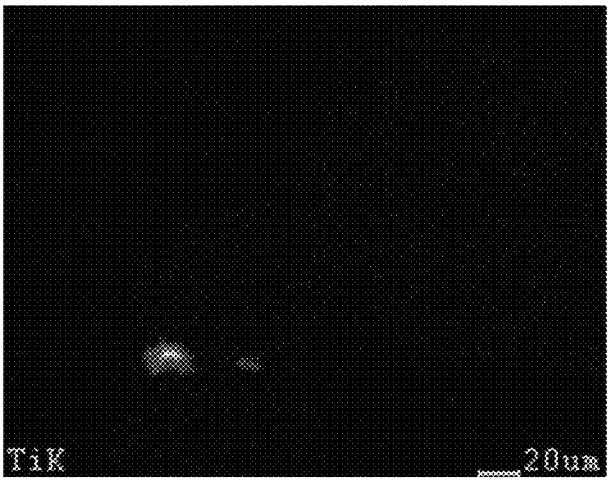
FIG. 2D is a diagram showing composition analysis results on titanium in the junction between the aluminum substrates of the porous aluminum sintered material shown in FIG. 1.

The porous aluminum sintered material 10, which is an embodiment of the present invention, is shown in FIG. 1. As shown in FIG. 1, the porous aluminum sintered material 10 of the present embodiment is what the aluminum substrates 11 are integrally combined by sintering; and the porosity of the porous aluminum sintered material 10 is set to the range of 30% or more and 90% or less in the present embodiment.

In the present embodiment, the aluminum fibers 11*a* and the aluminum powder 11*b* are used as the aluminum substrates 11 as shown in FIG. 1.

The pillar-shaped protrusions 12 projecting toward the outside are formed on the outer surfaces of the aluminum substrates 11 (the aluminum fibers 11*a* and the aluminum powder 11*b*). The porous aluminum sintered material of the present embodiment includes the junctions 15 in which multiple aluminum substrates 11 (the aluminum fibers 11*a* and the aluminum powder 11*b*) are bonded each other through the pillar-shaped protrusions 12. As shown in FIG. 1, each of the aluminum substrates 11, 11 includes: a part in which the pillar-shaped protrusions 12, 12 are bonded each other; a part in which the pillar-shaped protrusion 12 and the side surface of the aluminum substrate 11 are bonded each other; and a part in which the side surfaces of the aluminum substrates 11, 11 are bonded each other.

The junction 15 of the aluminum substrates 11, 11 bonded each other through the pillar-shaped protrusion 12, includes the Ti—Al compound 16 as shown FIGS. 2A to 2D.

The Ti—Al compound 16 is a compound of Ti and Al in the present embodiment as shown in the analysis results of FIGS. 2A to 2D. More specifically, it is $Al_3Ti$ intermetallic compound. In other words, the aluminum substrates 11, 11 are bonded each other in the part where the Ti—Al compound 16 exists in the present embodiment.

The eutectic alloy phase 17 including Al and Si is formed on the surface layer part of the junction 15, as shown in FIGS. 2A to 2D. In addition, in the inside part of the junction 15, there is almost no Si distributed; and the Si concentration is lower than the surface layer part of the junction 15 where the eutectic alloy phase 17 is provided.

The thickness of the eutectic alloy phase 17 is set in the range of 1 μm or more and 50 μm or less, for example.

Figure 4A:
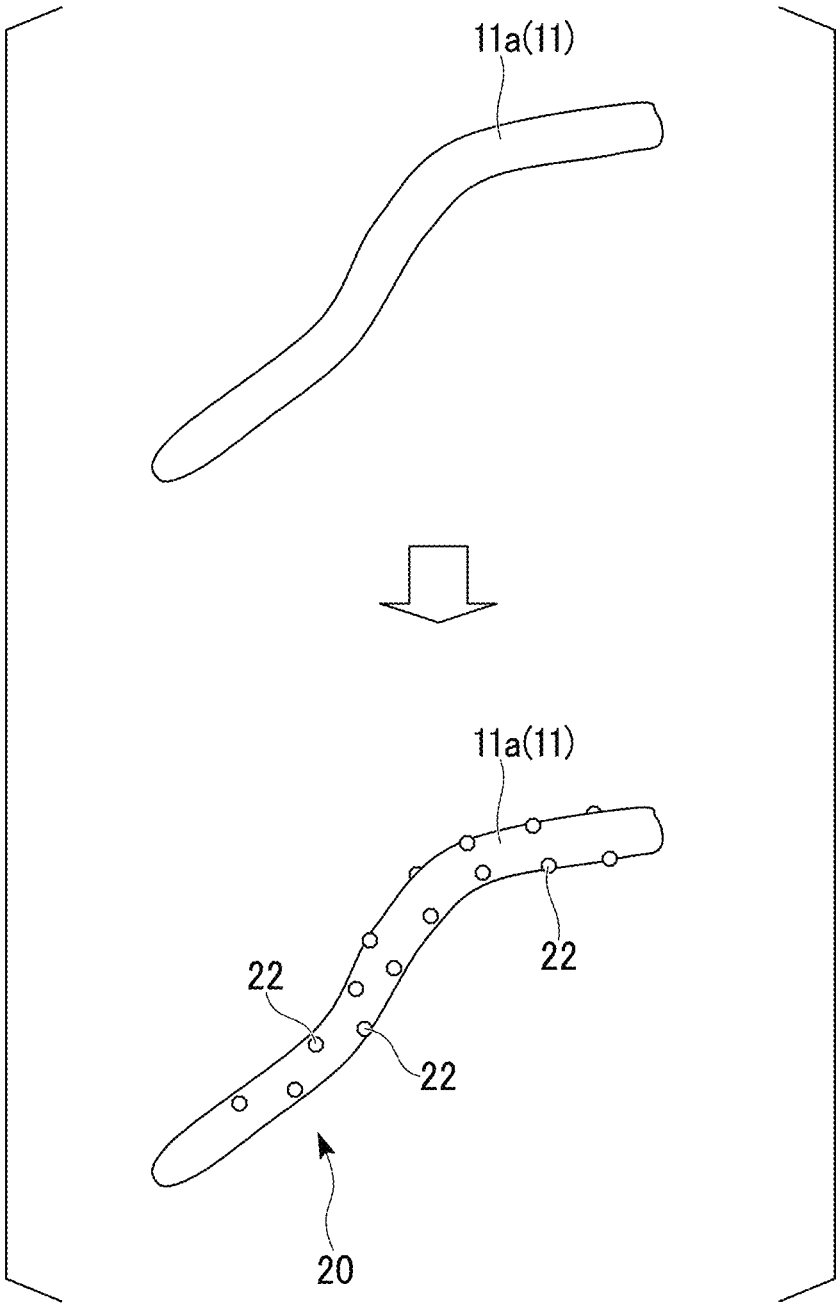
FIG. 4A is an explanatory diagram of the aluminum raw material for sintering in which the Ti—Si particles are adhered on the surfaces of the aluminum substrates.
Figure 4B:
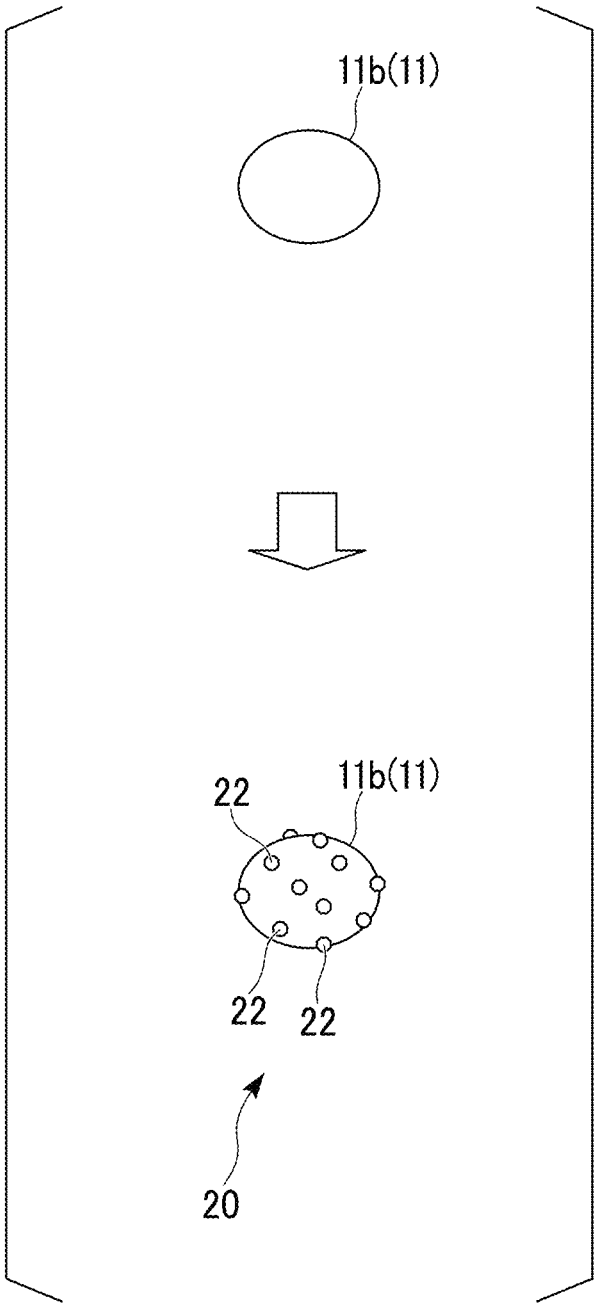
FIG. 4B is an explanatory diagram of the aluminum raw material for sintering in which the Ti—Si particles are adhered on the surfaces of the aluminum substrates.

Next, the aluminum raw material for sintering 20, which is the raw material of the porous aluminum sintered material 10 of the present embodiment, is explained. The aluminum raw material for sintering 20 includes: the aluminum substrate 11; and the Ti—Si particles 22 which are adhered on the outer surface of the aluminum substrate 11, as shown in FIGS. 4A and 4B. The Ti—Si particles 22 contain Ti and Si. As the aluminum substrates, as long as it is one of general aluminum alloys, any can be used suitably. In the present embodiment, the case in which the pure aluminum is used is explained as one of those examples.

The aluminum raw material for sintering 20 has the composition including: in addition to the aluminum substrates, 0.1 mass % or more and 20 mass % or less of Ti; 0.1 mass % or more and 15 mass % or less of Si; and the balance of inevitable impurities. In the present embodiment, the pure aluminum is used as the aluminum substrates. Thus, in the composition of the aluminum raw material for sintering 20: the Ti content is 0.1 mass % or more and 20 mass % or less; the Si content is 0.1 mass % or more and 15 mass % or less; and the balance of inevitable impurities.

The grain size of the Ti—Si particles 22 is set to the range of 5 μm or more and 250 μm or less. Preferably, it is set to 10 μm or more and 100 μm or less.

Moreover, it is preferable that the distance between the Ti—Si particles 22 adhered on the outer surface of the aluminum substrate 11 is set to the range of 5 μm or more and 100 μm or less.

As the aluminum substrate 11, the aluminum fibers 11*a* and the aluminum powder 11*b* are used as described above. As the aluminum powder 11*b*, an atomized powder can be used.

The fiber diameter of the aluminum fiber 11*a* is set to the range of 20 μm or more and 1000 μm or less. Preferably, it is set to the range of 50 μm or more and 500 μm or less. The fiber length of the aluminum fiber 11*a* is set to the range of 0.2 mm or more and 100 mm or less. Preferably, it is set to the range of 1 mm or more and 50 mm or less.

The grain size of the aluminum powder 11*b* is set to the range of 5 μm or more and 500 μm or less. Preferably, it is set to the range of 20 μm or more and 200 μm or less.

In addition, the porosity can be controlled by adjusting the mixing rate of the aluminum fibers 11*a* and the aluminum powder 11*b*. More specifically, the porosity of the porous aluminum sintered material can be improved by increasing the ratio of the aluminum fiber 11*a*. Because of this, it is preferable that the aluminum fibers 11*a* are used as the aluminum substrates 11. In the case where the aluminum powder 11*b* is mixed in, it is preferable that the ratio of the aluminum powder 11*b* in the aluminum substrates is set to 15 mass % or less.

Figure 3:
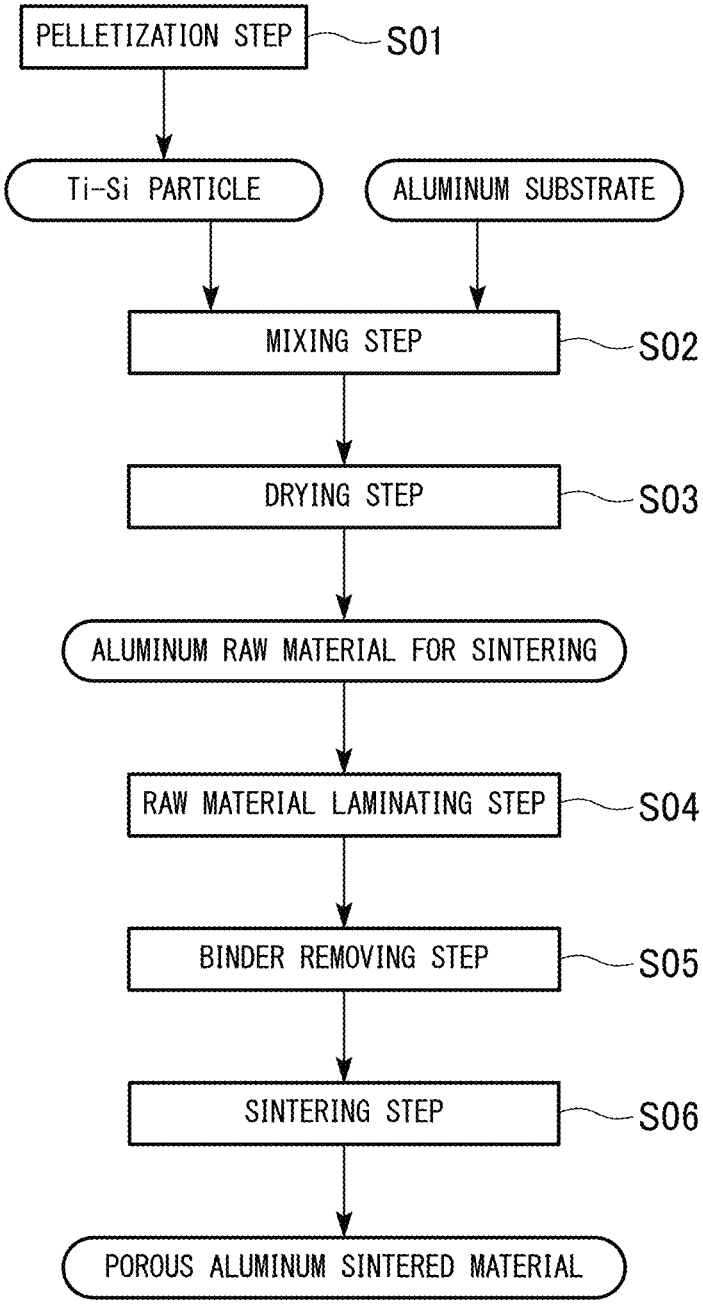
FIG. 3 is a flow diagram showing an example of the method of producing the porous aluminum sintered material shown in FIG. 1.

Next, the method of producing the porous aluminum sintered material 10 of the present embodiment is explained in reference to the flow diagram in FIG. 3 and the like.

First, the Ti—Si particles 22 are pelletized in the present embodiment, as shown in FIG. 3 (Pelletizing step S01).

The Ti powder and the Si powder are poured in a closed container with a binder solution. Then, they are mixed with a mixing apparatus such as the shaker mixer and the like. After mixing, the Ti—Si particles 22 are pelletized by drying.

As the Ti powder, the metallic titanium powder or the titanium hydride powder can be used. It is preferable that the grain size of the Ti powder is set in the range of 1 μm or more and 100 μm or less. In addition, it is preferable that the grain size of the Si powder is set in the range of 5 μm or more and 200 μm or less.

In addition, it is preferable that the mass ratio, Ti:Si, of the Ti powder and the Si powder poured in the closed container is set in the range of Ti:Si=1-5:0.1-10.

As the binder solution, it is preferable to use one being combusted and/or decomposed in heating at 500° C. in the air atmosphere. For example, a binder solution, in which an acrylic resin or a cellulosic polymer is diluted in a solvent (one of various solvents such as the water-based solvent, the alcohol-based solvent, and the organic solvent-based solvent), can be used.

In addition, the average grain size of the pelletized Ti—Si particles 22 is set in the range of 5 μm or more and 250 μm or less by adjusting: the grain sizes of the Ti powder and the Si powder; the mass ratio of the Ti powder to the Si powder; the concentration of the binder solution; the amount of the powders poured; and the like in the present embodiment. For example, in the case where the $TiH_2$ powder having the grain size of 5 μm and the Si powder having the grain size of 5 μm in the weight ratio of $TiH_2$:Si=1:1.5 are pelletized, the Ti—Si particles 22 having the average grain size of 20 μm are produced.

Next, the aluminum raw material for sintering 20 is produced by using the pelletized Ti—Si particles 22 and the aluminum substrates 11.

First, the aluminum substrates 11 and the Ti—Si particles 22 are mixed at the room temperature (the mixing step S02). At this time, the binder solution is sprayed on. As the binder, what is burned and decomposed during heating at 500° C. in the air is preferable. More specifically, using an acrylic resin or a cellulose-based polymer material is preferable. In addition, one of various solvents such as the water-based, alcohol-based, and organic-based solvents can be used as the solvent of the binder.

In the mixing step S02, the aluminum substrates 11 and the Ti—Si particle 22 are mixed by one of various mixing machines, such as an automatic mortar, a pan type rolling pelletizer, a shaker mixer, a pot mill, a high-speed mixer, a V-shaped mixer, and the like, while they are fluidized.

Next, the mixture obtained in the mixing step S02 is dried (the drying step S03). By the mixing step S02 and the drying step S03, the Ti—Si particles 22 are dispersedly adhered on the surfaces of the aluminum substrates 11 as shown in FIGS. 4A and 4B; and the aluminum raw material for sintering 20 in the present embodiment is produced. It is preferable that the Ti—Si particles 22 are dispersed in such a way that the distance between the Ti—Si particles 22 adhered on the outer surfaces of the aluminum substrates 11 is set to the range of 5 μm or more and 100 μm or less.

Next, the porous aluminum sintered material 10 is produced by using the aluminum raw material for sintering 20 obtained as described above.

Figure 5:
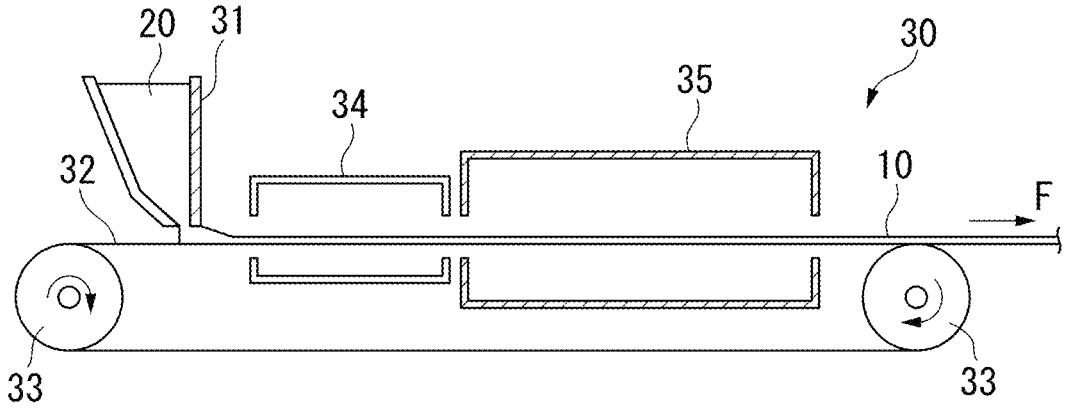
FIG. 5 is a schematic illustration of the continuous sintering apparatus for producing the porous aluminum sintered material in a sheet shape.

In the present embodiment, the porous aluminum sintered material 10 in the long sheet shape of: 300 mm of width; 1-5 mm of thickness; and 20 m of length, is produced, for example, by using the continuous sintering apparatus 30 shown in FIG. 5.

This continuous sintering apparatus 30 has: the raw material spreading device 31 spreading the aluminum raw material for sintering 20 evenly; the carbon sheet 32 holding the aluminum raw material for sintering 20 supplied from the raw material spreading device 31; the transport roller 33 driving the carbon sheet 32; the degreasing furnace 34 removing the binder by heating the aluminum raw material for sintering 20 transported with the carbon sheet 32; and the sintering furnace 35 sintering the binder-free aluminum raw material for sintering 20 by heating.

First, the aluminum raw material for sintering 20 is spread toward the upper surface of the carbon sheet 32 from the raw material spreading device 31; and the aluminum raw material for sintering 20 is laminated (the raw material laminating step S04).

The aluminum raw material for sintering 20 laminated on the carbon sheet 32 spreads in the width direction of the carbon sheet 32 during moving toward the traveling direction F to be uniformed and formed into a sheet shape. At this time, load is not placed upon. Thus, voids are formed between the aluminum substrates 11 in the aluminum raw material for sintering 20.

Next, the aluminum raw material for sintering 20, which is shaped into a sheet-shape on the carbon sheet 32, is inserted in the degreasing furnace 34 with the carbon sheet 32; and the binder is removed by being heated at a predetermined temperature (the binder removing step S05).

In the binder removing step S05, the aluminum raw material for sintering 20 is maintained at 350° C. to 500° C. for 0.5 to 5 minutes in the air atmosphere A; and the binder in the aluminum raw material for sintering 20 is removed. In the present embodiment, the binder is used only for having the Ti—Si particles 22 adhere on the outer surfaces of the aluminum substrates 11 as described above. Thus, the content amount of the binder is extremely low compared to the viscous compositions; and the binder can be removed sufficiently in a short time.

Next, the aluminum raw material for sintering 20 free of the binder is inserted in the sintering furnace 35 with the carbon sheet 32 and sintered by being heated at a predetermined temperature (the sintering step S06).

The sintering step S06 is performed by maintaining the aluminum raw material for sintering 20 at 600° C. to 655° C. for 0.5 to 60 minutes in an inert gas atmosphere. It is preferable that the retention time in the sintering step S06 is set to 1 minute to 20 minutes. In the case where an aluminum alloy having the melting point at Tm° C. is used for the aluminum substrates, the retention time is adjusted in the range of Tm-60° C. to Tm° C. appropriately by adjusting the ratio of Ti to Si in the Ti—Si particles.

In the sintering step S06, the aluminum substrates 11 in the aluminum raw material for sintering 20 are melted. Since the oxide films are formed on the surfaces of the aluminum substrates 11, the melted aluminum is held by the oxide film; and the shapes of the aluminum substrates 11 are maintained.

Figure 6A:
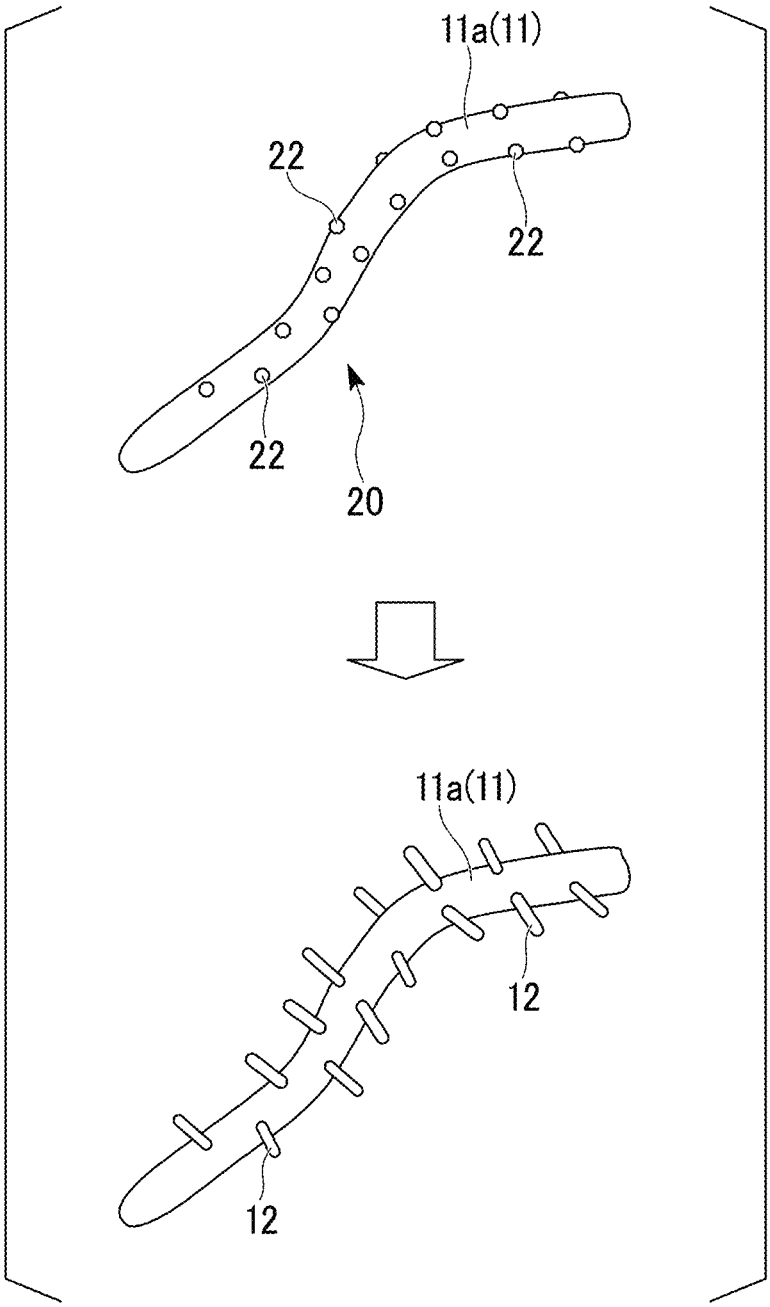
FIG. 6A is an explanatory diagram showing the state where the pillar-shaped protrusions are formed on the outer surfaces of the aluminum substrates in the step of sintering.
Figure 6B:
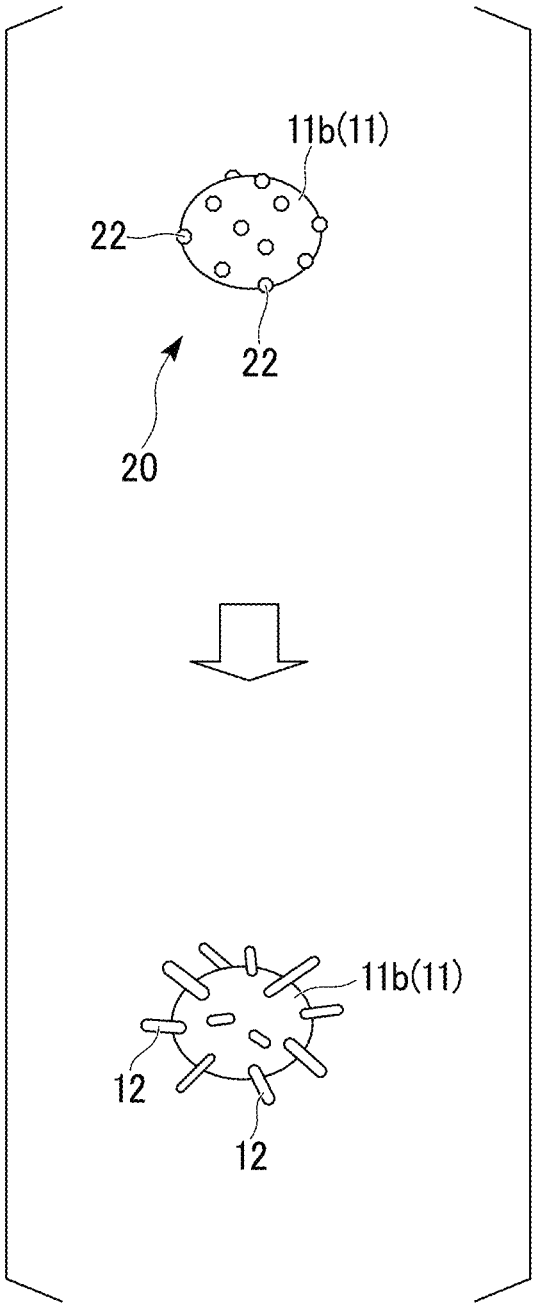
FIG. 6B is an explanatory diagram showing the state where the pillar-shaped protrusions are formed on the outer surfaces of the aluminum substrates in the step of sintering.

In the part where the Ti—Si particles 22 are adhered among the outer surfaces of the aluminum substrates 11, the oxide films are destroyed by the reaction with Ti of the Ti—Si particles 22; and the melted aluminum inside spouts out. The spouted out melted aluminum forms a high-melting point compound by reacting with titanium to be solidified. Because of this, the pillar-shaped protrusions 12 projecting toward the outside are formed on the outer surfaces of the aluminum substrates 11 as shown in FIGS. 6A and 6B. On the tip of the pillar-shaped protrusion 12, the Ti—Al compound 16 exists. Growth of the pillar-shaped protrusion 12 is suppressed by the Ti—Al compound 16.

In the case where titanium hydride ($TiH_2$) is used as a material of the Ti—Si particles 22, titanium hydride is decomposed near the temperature of 300° C. to 400° C.; and the produced titanium reacts with the oxide films on the surfaces of the aluminum substrates 11.

In addition, in the present embodiment, the eutectic alloy phase 17 is formed by the reaction between Si and Al in the Ti—Si particles 22. As described above, the melted and spouted out aluminum forms the compound having a high melting point by reacting with titanium to be solidified. Thus, diffusion of Si into the inside part of the pillar-shaped protrusions 12 is suppressed. Because of this, the eutectic alloy phase 17 is provided on the surface layer of the pillar-shaped protrusions 12; and the Si concentration in the inside part of the pillar-shaped protrusions 12 is lower than the Si concentration on the surface layer part of the pillar-shaped protrusions 12.

At this time, the adjacent the aluminum substrates 11, 11 are bonded each other by being combined integrally in a molten state or being sintered in a solid state through the pillar-shaped protrusions 12 of each. Accordingly, the porous aluminum sintered material 10, in which the aluminum substrates 11, 11 are bonded each other through the pillar-shaped protrusions 12 as shown in FIG. 1, is produced. In addition, the junction 15, in which the aluminum substrates 11, 11 are bonded each other through the pillar-shaped protrusion 12, includes the Ti—Al compound 16 ($Al_3Ti$ intermetallic compound in the present embodiment); and the eutectic alloy phase 17 is provided on the surface layer of the junction 15.

In the porous aluminum sintered material 10 of the present embodiment configured as described above, the junction 15 of the aluminum substrates 11, 11 includes the Ti—Al compound 16. Thus, the oxide films formed on the surfaces of the aluminum substrates 11 are removed by the Ti—Al compound 16; and the aluminum substrates 11, 11 are bonded properly each other. Therefore, the high-quality porous aluminum sintered material 10 having sufficient strength can be obtained.

In addition, since the growth of the pillar-shaped protrusions 12 is suppressed by the Ti—Al compound 16, spouting out of the melted aluminum into the voids between the aluminum substrates 11, 11 can be suppressed; and the porous aluminum sintered material 10 having high porosity can be obtained.

Moreover, $Al_3Ti$ exists as the Ti—Al compound 16 in the junction 15 of the aluminum substrates 11, 11 in the present embodiment. Thus, the oxide films formed on the surfaces of the aluminum substrates 11 are removed reliably; and the aluminum substrates 11, 11 are bonded properly each other. Therefore, strength of the porous aluminum sintered material 10 can be ensured.

In addition, the eutectic alloy phase 17 including Al and Si is provided in the junction 15, in which the aluminum substrates 11 are bonded each other, in the present embodiment. Thus, the junction 15 is strengthened by the eutectic alloy phase 17; and the strength of the entire porous aluminum sintered material 10 can be improved.

Moreover, the eutectic alloy phase 17 including Al and Si is provided on the surface layer of the junction 15; and the Si concentration in the inside part of the junction 15 is lower than the Si concentration on the surface layer part of the junction 15. Thus, the electrical resistance and the thermal resistance in the junction 15 are reduced; and the electrical conductivity and the thermal conductivity of the porous aluminum sintered material 10 can be ensured.

In addition, the porous aluminum sintered material 10 has the structure in which the aluminum substrates 11, 11 are bonded each other through the pillar-shaped protrusions 12 formed on the outer surfaces of the aluminum substrates 11. Thus, the porous aluminum sintered material 10 having high porosity can be obtained without performing the step of foaming or the like separately. Therefore, the porous aluminum sintered material 10 of the present embodiment can be produced efficiently at low cost.

Especially, the continuous sintering apparatus 30 shown in FIG. 5 is used in the present embodiment. Thus, the sheet-shaped porous aluminum sintered material 10 can be produced continuously; and the production efficiency can be improved significantly.

Moreover, in the present embodiment, the content amount of the binder is extremely low compared to the viscous compositions. Thus, the binder removing step S05 can be performed in a short time. In addition, the shrinkage rate during sintering becomes about 1%, for example; and the porous aluminum sintered material 10 having excellent dimensional accuracy can be obtained.

In addition, the aluminum fibers 11*a* and the aluminum powder 11*b* are used as the aluminum substrates 11 in the present embodiment. Thus, the porosity of the porous aluminum sintered material 10 can be controlled by: adjusting the mixing ratio thereof, the grain sizes and the aspect ratios of the aluminum substrates themselves, and various parameters related to their shapes such as being bended or twisted; and performing press molding in the molding step as needed.

In addition, the aluminum raw material for sintering 20 has the composition including: in addition to the aluminum substrates, 0.1 mass % or more and 20 mass % or less of Ti; 0.1 mass % or more and 15 mass % or less of Si; and the balance of inevitable impurities in the present embodiment. Thus, the aluminum substrates 11 are bonded each other reliably by forming the pillar-shaped protrusions 12; and the eutectic alloy phase 17 is formed reliably. Accordingly, the porous aluminum sintered material 10 having a sufficient strength can be obtained. In addition, excessive formation of the liquid phase is suppressed in the sintering step S06; and the voids between each of the aluminum substrates being filled up with the melted aluminum can be prevented. Accordingly the porous aluminum sintered material 10 having a high porosity can be obtained.

In addition, the Ti—Si particles 22 are formed by kneading and pelletizing the Ti powder, which is made of one of or both of metallic titanium and titanium hydride, and the Si powder with the binder in the present embodiment. Thus, Ti and Si can be adhered on the same location on the outer surface of the aluminum substrates 11 reliably, and the above-described aluminum sintered material 10 can be obtained.

In addition, the average grain size of the pelletized Ti—Si particles 22 is set in the range of 5 μm to 250 μm; and the distance between the Ti—Si particles 22 adhered on the outer surfaces of the aluminum substrates 11 is set to the range of 5 μm or more and 100 μm or less in the present embodiment. Thus, the multiple pillar-shaped protrusions 12 are formed with a proper interval; and the porous aluminum sintered material 10 having a high porosity and a high strength can be obtained.

In addition, the aluminum fibers 11*a* and the aluminum powder 11*b* are used as the aluminum substrates 11; and the ratio of the aluminum powder 11*b* relative to the aluminum substrates 11 is set to 15 mass % or less in the present embodiment. Thus, the porous aluminum sintered material 10 with high porosity can be obtained.

Embodiments of the present invention are explained above. However, the present invention is not particularly limited by the description of the embodiments; and the present invention can be modified as need in the range that does not depart from the technical concept of the present invention as defined in the scope of the present invention.

For example, it is explained that the porous aluminum sintered material is continuously produced by using the continuous sintering apparatus shown in FIG. 5. However, the present invention is not limited by the description, and the porous aluminum sintered material may be produced by using other producing apparatus In addition, the sheet-shaped porous aluminum sintered materials are explained in the present embodiment. However, the present invention is not particularly limited by the description, and it may be the bulk-shaped porous aluminum sintered material produced by the production process shown in FIG. 7, for example.

Figure 7:
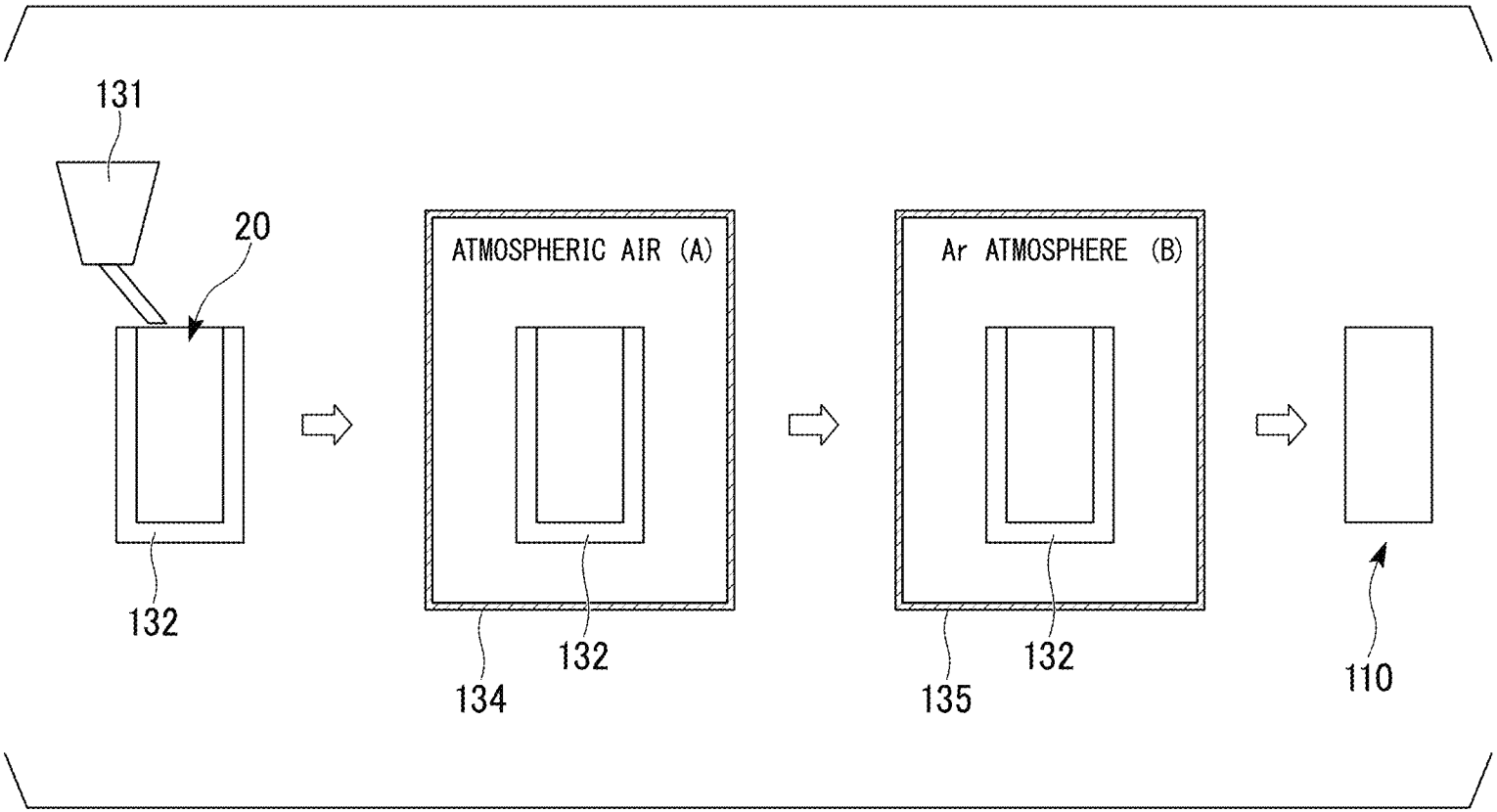
FIG. 7 is an explanatory diagram showing the production process for producing the porous aluminum sintered material in a bulk-shape.
Figure 8A:
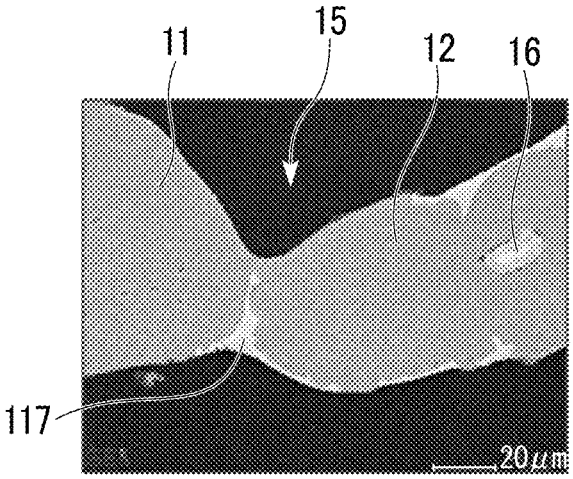
FIG. 8A is a figure showing SEM observation of the junction between the aluminum substrates in the porous aluminum sintered material of other embodiment of the present invention.
Figure 8B:
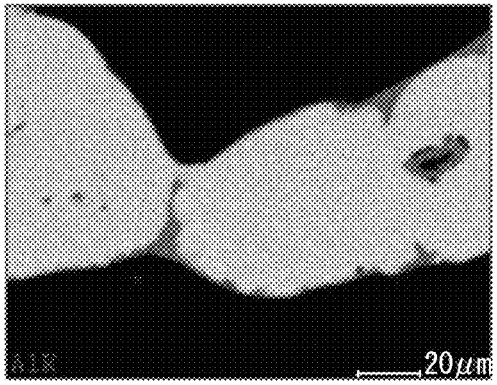
FIG. 8B is a figure showing composition analysis results on aluminum in the junction between the aluminum substrates in the porous aluminum sintered material of other embodiment of the present invention.
Figure 8C:
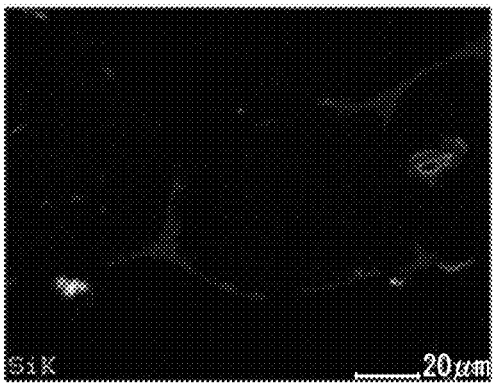
FIG. 8C is a figure showing composition analysis results on silicon in the junction between the aluminum substrates in the porous aluminum sintered material of other embodiment of the present invention.
Figure 8D:
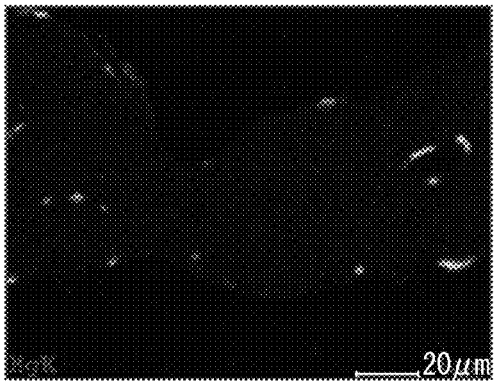
FIG. 8D is a figure showing composition analysis results on magnesium in the junction between the aluminum substrates in the porous aluminum sintered material of other embodiment of the present invention.
Figure 8E:
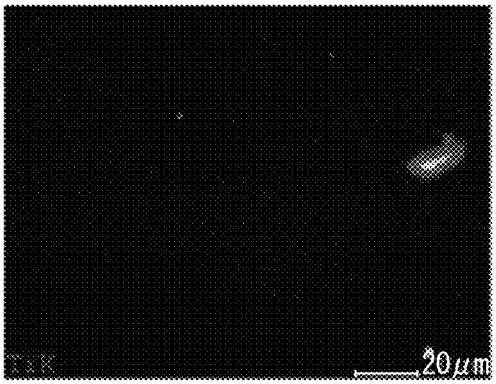
FIG. 8E is a figure showing composition analysis results on titanium in the junction between the aluminum substrates in the porous aluminum sintered material of other embodiment of the present invention.

As shown in FIG. 7, the aluminum raw material for sintering 20 is spread to bulk fill on the carbon-made container 132 from the raw material spreader 131 spreading the aluminum raw material for sintering 20; and press molding is performed as needed (the raw material laminating step). Then, the container 132 is inserted in the degreasing furnace 134; and the binder is removed by heating under air atmosphere A (the binder removing step). Then, the container is inserted in the sintering furnace 135; and heated to and retained at 600° C. to 655° C. under an Ar atmosphere B to obtain the bulk-shaped porous aluminum sintered material 110. In the case where an aluminum alloy having the melting point at Tm° C. is used for the aluminum substrates of the aluminum raw material for sintering 20, the retention time is adjusted in the range of Tm-60° C. to Tm° C. appropriately by adjusting the ratio of Ti to Si in the Ti—Si particles.

In the present explanation, the bulk-shaped porous aluminum sintered material 110 can be taken out from the carbon-made container 132 relatively easily, since a carbon-made container having excellent mold releasing characteristics is used as the carbon-made container 132; and the content is shrunk in the shrinkage rate about 1% during sintering.

In addition, it is explained that the Ti—Si particles 22 contains Ti and Si in the present embodiment. However, the present invention is not limited to the explanation; and the Ti—Si particles 22 may contain Mg in addition to Ti and Si.

In this case, it is preferable that the aluminum raw material for sintering has the composition including: in addition to the aluminum substrates, 0.1 mass % or more and 20 mass % or less of Ti; 0.1 mass % or more and 15 mass % or less of Si; 0.1 mass % or more and 5 mass % or less of Mg; and the balance of inevitable impurities.

The Ti—Si particles containing Mg (that is Ti—Si—Mg particles) are pelletized by: pouring the Ti powder, the Si powder and the Mg powder in a closed container with a binder solution; mixing them with a mixing apparatus such as the shaker mixer and the like; and then drying.

It is preferable that the grain size of the Mg powder is set in the range of 20 μm or more and 500 μm or less. In addition, it is preferable that the mass ratio, Ti:Si: Mg, between the Ti powder, the Si powder and the Mg powder is set in the range of Ti:Si:Mg=0.1-2:0.1-10:0.1-5. In terms of the binder solution, one used in the above-described embodiment can be utilized. The average grain size of the pelletized Ti—Si particles (Ti—Si—Mg particles) is set in the range of 20 μm or more and 550 μm or less by adjusting: the grain sizes of the Ti powder, the Si powder and the Mg powder; the mass ratio between the Ti powder, the Si powder and the Mg powder; the concentration of the binder solution; the amount of the powders poured; and the like. For example, in the case where the $TiH_2$ powder having the grain size of 5 μm, the Si powder having the grain size of 5 μm, and the Mg powder having the grain size of 30 μm, in the weight ratio of $TiH_2$:Si:Mg=1:1.5:1 are pelletized, the Ti—Si particles (the Ti—Si—Mg particles) having the average grain size of 40 μm are produced.

In the case where the Ti—Si particles containing Mg are used, the Ti—Al compound 16 is provided to the junction 15 of the aluminum substrates 11, 11 bonded through the pillar-shaped protrusions 12; and the eutectic alloy phase 117 containing Al, Si and Mg in the surface layer part of the junction 15, as shown in FIGS. 8A to 8E. In addition, there is almost no Si or Mg distributed in the inside part of the junction 15; and the concentrations of Si and Mg in the inside part of the junction 15 are lower than the concentration s of Si and Mg on the surface layer part of the junction 15 having the eutectic alloy phase 117. The eutectic alloy phase 117 is formed with the thickness thicker than the eutectic alloy phase 17 made of Al and Si, which is explained in the above-described embodiment. Specifically, the thickness of the eutectic alloy phase 117 is set in the range of 2 μm or more and 100 μm or less. By satisfying the configuration, the strength of the junction 15 is further improved; and the porous aluminum sintered material having a higher strength can be obtained.

In addition, it is explained that the aluminum substrates made of the pure aluminum are used in the present embodiment. However, the present invention is not limited by the description, and aluminum substrates made of one of general aluminum alloys can be used.

For example, in the case where the aluminum substrates made of the A3003 alloy (Al-0.6 mass % Si-0.7 mass % Fe-0.1 mass % Cu-1.5 mass % Mn-0.1 mass % Zn alloy), the A5052 alloy (Al-0.25 mass % Si-0.40 mass % Fe-0.10 mass % Cu-0.10 mass % Mn-2.5 mass % Mg-0.2 mass % Cr-0.1 mass % Zn alloy) as defined in JIS, and the like is used, Si and/or Mg are included in the composition of the alloy. In addition to the elements of the alloy such as Si, Mg and the like contained in the aluminum substrates, the entire composition of the aluminum raw material includes: 0.1 mass % or more and 20 mass % or less of Ti; 0.1 mass % or more and 15 mass % or less of Si; and the balance of inevitable impurities. Alternatively, the entire composition of the aluminum raw material includes: in addition to the elements of the alloy such as Si, Mg and the like contained in the aluminum substrates, 0.1 mass % or more and 20 mass % or less of Ti; 0.1 mass % or more and 15 mass % or less of Si; 0.1 mass % or more and 5 mass % or less of Mg; and the balance of inevitable impurities.

In addition, the composition of the aluminum substrates is not limited to a specific single kind composition. It can be appropriately adjusted depending on the purpose, for example, like using the mixture of fibers made of the pure aluminum and the powder made of JIS A3003 alloy.

EXAMPLES

Results of confirmatory experiments performed to confirm the technical effect of the present invention are explained below.

By the methods shown in the above-described embodiments and using the raw materials shown in Table 1, the aluminum raw materials for sintering were prepared. The aluminum fibers made of A1070 (the pure aluminum), the fiber diameter of which was 20 μm or more and 1000 μm or less; and the aluminum powder, the grain size of which was 5 μm or more and 500 μm or less, were used as the aluminum substrates In Examples 1 to 8 of the present invention, the Ti—Si particles (Ti—Si—Mg particles) were pelletized by the method shown in the above-described embodiment using the $TiH_2$ powder, the Si powder, and the Mg powder. Then, the aluminum raw material for sintering was produced by the method shown in the above-described embodiment using the Ti—Si particles (the Ti—Si—Mg particles) and the aluminum substrates.

On the other hand, in Comparative Examples 1 and 2, the $TiH_2$ powder, the Si powder, and the Mg powder were mixed with the aluminum substrate as they were to produce the aluminum raw material for sintering.

By using the above-described aluminum raw materials, the porous aluminum sintered materials having the dimension of: 30 mm of the width; 200 mm of the length; and 5 mm of the thickness, were produced by the method shown in the above-described embodiment. The condition for the sintering step was: 630° C. of the sintering temperature; and 15 minutes of the retention time at the sintering temperature.

The apparent porosity, the tensile strength, and the electrical resistance were evaluated on the obtained porous aluminum sintered materials by the methods shown below. Evaluation results are shown in Table 1.

[Apparent Porosity]

The mass m (g), the volume V ($cm^3$), and the true density d ($g/cm^3$) were measured in the obtained porous aluminum sintered materials; and the apparent porosity was calculated by using the formula shown below.

$$\text{Apparent Porosity } (\%)=(1-(m/(V\times d)))\times 100$$

The true density ($g/cm^3$) was measured by the water method with the precision balance.

[Tensile Strength]

The obtained porous aluminum sintered materials were machined into test pieces, which of which had the dimension of: 10 mm of the width; 100 mm of the length; and 5 mm of the thickness. Then, the tensile strength was measured by the pulling method with the Instron tensile strength testing machine.

[Electrical Resistivity]

The electrical resistance R of the test pieces having the cross sectional area of A ($cm^2$) and the length L (cm) was measured by using the decimal multimeter; and the electrical resistivity was calculated from the equation below.

$$\text{Electrical resistivity } \rho\ (m\Omega/\text{cm})=R(m\Omega)\times A(\text{cm}^2)/L\ (\text{cm})$$

TABLE 1

| | | Aluminum raw material for sintering (mass %) | | | | Apparent porosity | Tensile strength | Electrical resistivity |
|---|---|---|---|---|---|---|---|---|
| | | $TiH_2$ | Si | Mg | Al | (%) | ($N/mm^2$) | (mΩ/cm) |
| Example of the present invention | 1 | 1.0 | 1.5 | — | balance | 70.9 | 2.1 | 0.053 |
| | 2 | 5.0 | 1.5 | — | balance | 70.3 | 3.9 | 0.091 |
| | 3 | 1.0 | 0.5 | — | balance | 70.4 | 1.8 | 0.192 |
| | 4 | 1.0 | 10.0 | — | balance | 69.5 | 4.4 | 0.128 |
| | 5 | 1.0 | 1.5 | 1.0 | balance | 70.9 | 6.1 | 0.047 |
| | 6 | 5.0 | 1.5 | 1.0 | balance | 70.6 | 5.9 | 0.083 |
| | 7 | 1.0 | 0.1 | 1.0 | balance | 70.3 | 3.1 | 0.172 |
| | 8 | 1.0 | 10.0 | 1.0 | balance | 69.5 | 8.2 | 0.102 |
| Comparative Example 1 | | 1.0 | 1.5 | — | balance | 71.0 | 2.4 | 0.248 |
| Comparative Example 2 | | 1.0 | 1.5 | 1.0 | balance | 69.8 | 6.4 | 0.253 |

As shown in Table 1, the electrical resistivity was low in Examples 1 to 8 of the present invention, in which the Ti—Si particles (Ti—Si—Mg particles) were used, compared to Comparative Examples 1 and 2, in which the $TiH_2$ powder, the Si powder, and the Mg powders were used as they were, confirming that the electrical conductivity was excellent in Examples 1 to 8 of the present invention. In addition, it was confirmed that the porosity and the strength were excellent in Examples 1 to 8 of the present invention.

Based on the results explained above, it was confirmed that according to the present invention, a porous aluminum sintered material having a high porosity; a sufficient strength; and excellent electrical conductivity and thermal conductivity can be provided.

INDUSTRIAL APPLICABILITY

A porous aluminum sintered material having a high porosity; a sufficient strength; and excellent electrical conductivity and thermal conductivity is provided.

REFERENCE SIGNS LIST

10, 110: Porous aluminum sintered material
11: Aluminum substrate
11*a:* Aluminum fiber
11*b:* Aluminum powder
12: Pillar-shaped protrusion
15: Junction
16: Ti—Al compound
17, 117: Eutectic alloy phase
20: Aluminum raw material for sintering
22: Ti—Si particle
A: Air atmosphere
B: Ar atmosphere

What is claimed is:

1. A porous aluminum sintered material comprising a plurality of aluminum substrates sintered each other, wherein pillar-shaped protrusions projecting toward an outside are formed on outer surfaces of the aluminum substrates, the porous aluminum sintered material has junctions in which the aluminum substrates are bonded each other through the pillar-shaped protrusions, the junctions include Ti—Al compound, and a eutectic alloy phase including Al and Si is provided on surface layers of the junctions.

2. The porous aluminum sintered material according to claim 1, wherein the eutectic alloy phase further includes Mg.

3. The porous aluminum sintered material according to claim 1, wherein the aluminum substrates are made of any one of or both of aluminum fibers and aluminum powder.

* * * * *